US008608262B1

(12) United States Patent
Daros

(10) Patent No.: US 8,608,262 B1
(45) Date of Patent: Dec. 17, 2013

(54) EXPANDABLE DRAWER

(76) Inventor: Davide A. Daros, Ottawa (CA)

( * ) Notice: Subject to any disclaimer, the term of this patent is extended or adjusted under 35 U.S.C. 154(b) by 53 days.

(21) Appl. No.: 13/296,897

(22) Filed: Nov. 15, 2011

Related U.S. Application Data

(60) Provisional application No. 61/413,499, filed on Nov. 15, 2010.

(51) Int. Cl.
*A47B 95/00* (2006.01)

(52) U.S. Cl.
USPC ..... 312/348.2; 312/205

(58) Field of Classification Search
USPC ..... 312/205, 348.1, 348.2, 348.3, 330.1; 220/8; 190/22, 105; 108/93
See application file for complete search history.

(56) References Cited

U.S. PATENT DOCUMENTS 885,853 A * 4/1908 Mable ..... 190/104
1,120,955 A * 12/1914 Martin ..... 229/101
1,730,069 A * 10/1929 Gebser ..... 220/545
1,817,107 A * 8/1931 Spery ..... 190/15.1
1,941,375 A * 12/1933 Wildman ..... 224/42.34
2,369,728 A * 2/1945 Farkas ..... 294/168
3,272,583 A 9/1966 Averdieck
3,691,671 A * 9/1972 Kroll ..... 446/476
4,337,861 A * 7/1982 Smart ..... 206/579
4,624,502 A 11/1986 Boole
4,909,406 A 3/1990 Wu
5,082,094 A * 1/1992 Nechushtan ..... 190/105
5,322,365 A 6/1994 Teufel et al.
7,100,882 B2 * 9/2006 Behroozi ..... 248/317
7,451,912 B1 * 11/2008 Taube, II ..... 232/29
7,562,949 B1 * 7/2009 Nielsen ..... 312/7.2
7,594,706 B2 * 9/2009 Styka et al. ..... 312/228

* cited by examiner

*Primary Examiner* — Janet M Wilkens
(74) *Attorney, Agent, or Firm* — Robert C. Montgomery; Montgomery Patent & Design

(57) ABSTRACT

An expandable drawer adaptable to various size openings comprises a pair of locking tracks and expanding wall and floor portions. The expanding drawer assembly comprises a conventional drawer with width adjustment features along front, back, and bottom surfaces. The drawer's width is adjustable to correspond to the width of the opening, allowing the device to fully occupy the prescribed space.

14 Claims, 8 Drawing Sheets

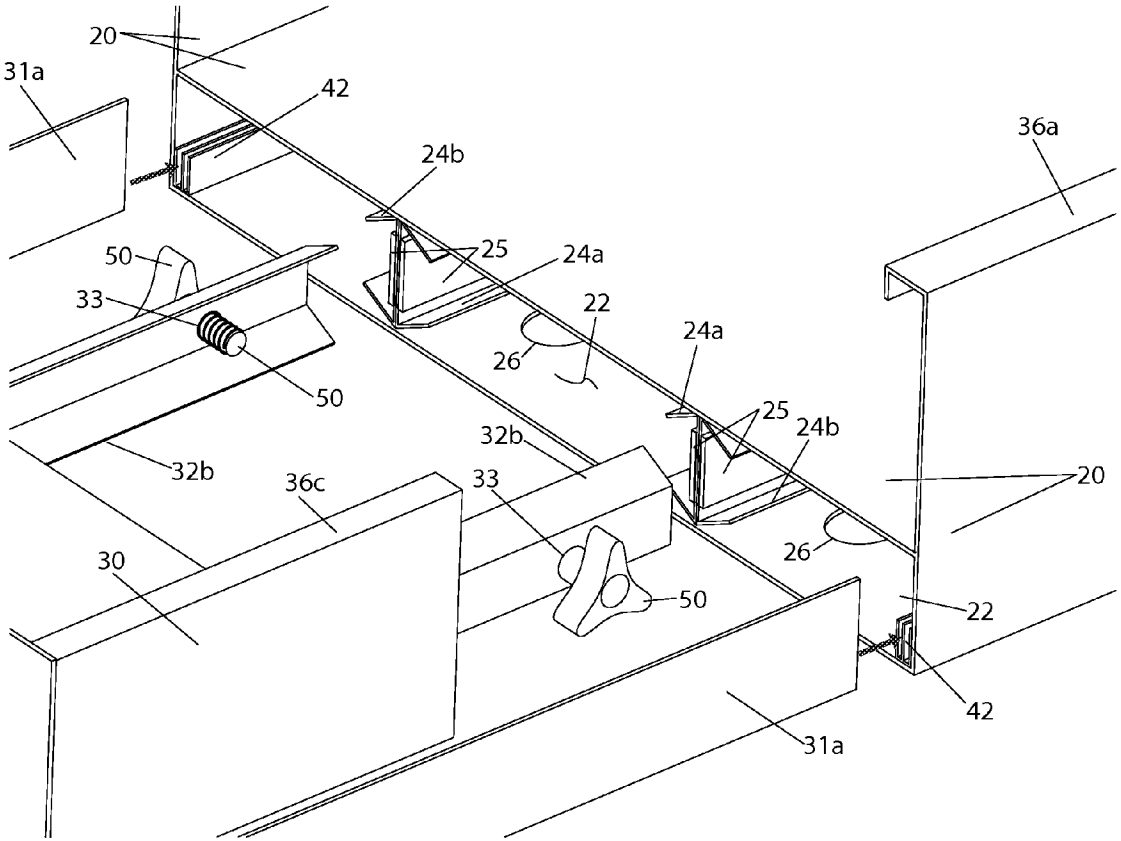
Fig. 6b
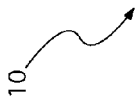

EXPANDABLE DRAWER

RELATED APPLICATIONS

The present invention was first described in and claims the benefit of U.S. Provisional Application No. 61/413,499 filed on Nov. 15, 2010, the entire disclosures of which are incorporated herein by reference.

FIELD OF THE INVENTION

The present invention relates generally to drawers, and in particular, to the horizontal extension of drawers.

BACKGROUND OF THE INVENTION

Drawers which are used to store items are known. Drawers are used in kitchens, bathrooms, bedrooms, and the like. The drawer sizes vary as depending upon the items being stored and the position within a cabinet. Therefore, drawers are limited to their maximum capacity.

Various attempts have been made to provide an expandable drawer. Examples of these attempts can be seen by reference to several U.S. patents. U.S. Pat. No. 3,272,583, issued in the name of Averdieck, describes a sliding adjustable drawer.

U.S. Pat. No. 4,909,406, issued in the name of Wu, describes a container which is extendable lengthwise.

U.S. Pat. No. 5,322,365, issued in the name of Teufel et al., describes a vertically extending rail system for drawers.

While these devices fulfill their respective, particular objectives, each of these references suffer from one (1) or more disadvantages. Many are not suited to adjust horizontally. Others are not suited for cabinets. Accordingly, there exists a need for an expandable drawer without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for an expandable drawer.

Accordingly, it is an object of the present embodiments of the invention to solve at least one (1) of these problems. The inventor has addressed this need by developing an expandable drawer which horizontally expands and is constructed for various cabinets.

To achieve the above objectives, it is an object of the present invention to provide a universally expandable drawer to customize the width of drawers and increase storage space.

Another object of the present invention is to provide a center section having a first center side and a second center side, a first end section having a first end side and a second end side, a second end section having a third end side and a fourth end side, a first intermediate section having a first intermediate side and a second intermediate side, and a second intermediate section having a third intermediate side and a fourth intermediate side.

Yet still another object of the present invention is to provide adjustments via a pair of inner rail guides, a pair of outer rail guides, a pair of inner extension rails, a pair of outer extension rails, and a plurality of tightening knob fasteners.

Yet still another object of the present invention is to provide the extension rails with threaded apertures for receiving a standard threaded knob fastener.

Yet still another object of the present invention is to provide the end sections with runners for motioning upon a cabinet rail assembly.

Yet still another object of the present invention is to provide a method of utilizing the device that provides a unique means of pre-adjusting a width of the device, extending each end section, installing the intermediate sections, tightening the knob fasteners, positioning the device into the existing cabinet rail assembly, and loading the device.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 7:
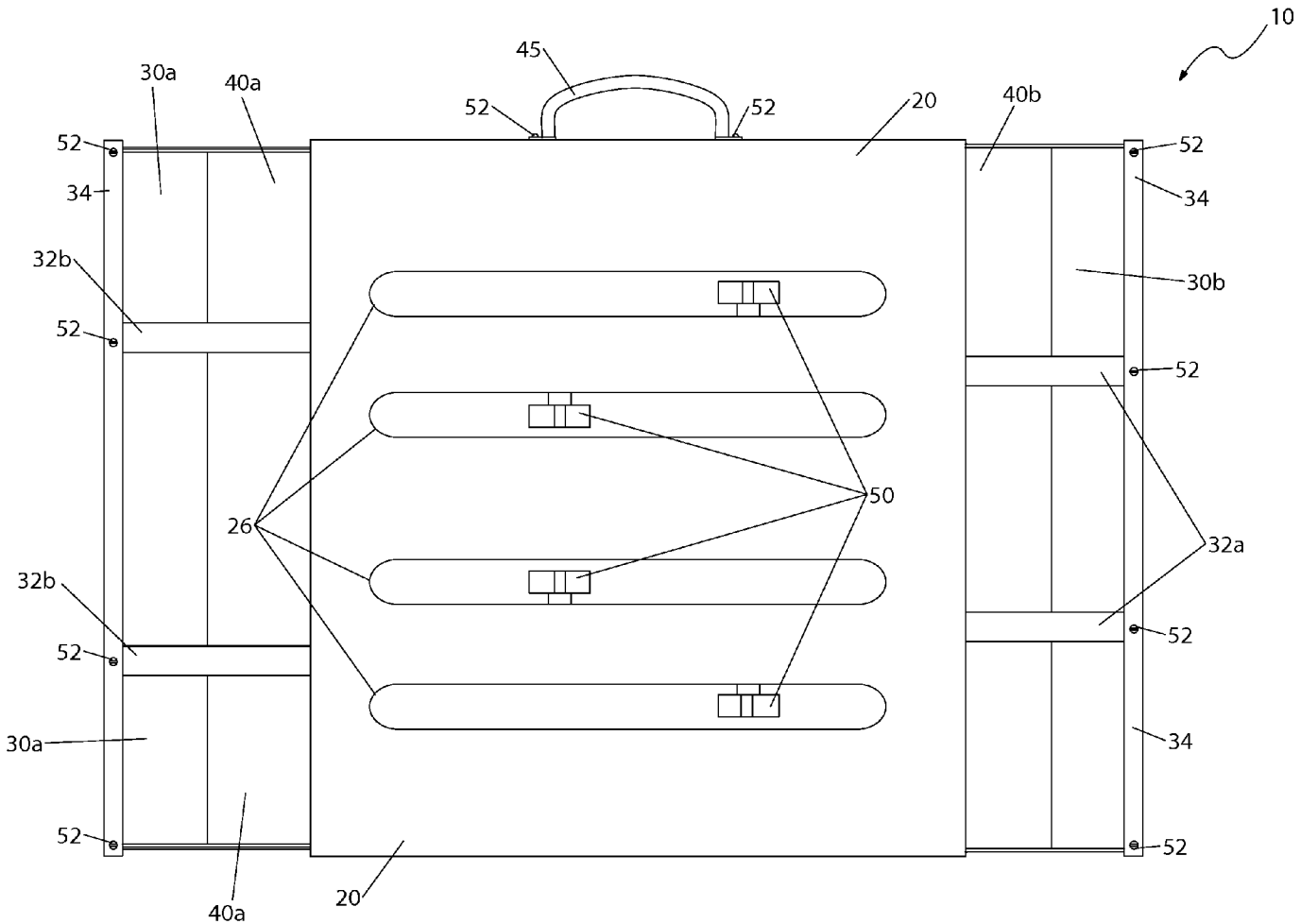

FIG. **6*a* is a partially exploded view of the expandable drawer 10 depicting inner rail guides 24*a* and inner extension rails 32*a***, according to the preferred embodiment of the present invention;

FIG. **6*b* is a partially exploded view the expandable drawer 10 depicting outer rail guides 24*b* and outer extension rails 32*b*, according to the preferred embodiment of the present invention; and, FIG. 7** is a bottom view of the expandable drawer, according to the preferred embodiment of the present invention.

DESCRIPTIVE KEY

| | |
|---|---|
| 10 | expandable drawer |
| 20 | center section |
| 21 | stiffener |
| 22 | tunnel portion |
| 24a | inner rail guide |
| 24b | outer rail guide |
| 25 | bearing plate |
| 26 | slot |
| 30a | first end section |
| 30b | second end section |
| 31a | first end section skirt |
| 31b | second end section skirt |
| 32a | inner extension rail |
| 32b | outer extension rail |
| 33 | threaded aperture |
| 34 | runner |
| 36a | center edge guide |
| 36b | intermediate edge guide |
| 36c | end edge guide |

-continued

| | |
|---|---|
| 40a | first intermediate section |
| 40b | second intermediate section |
| 42 | skirt guide |
| 45 | handle |
| 50 | knob fastener |
| 52 | threaded fastener |
| 60 | cabinet rail assembly |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an expandable drawer (herein described as the "device") 10, which provides a means by which customized width drawers can be easily and quickly constructed without the time or cost considerations of custom cabinetry work. The development and use of the device 10 provides increased storage space in a wide variety of areas without the high cost or specialized work associated with custom-made cabinets.

Figure 1:
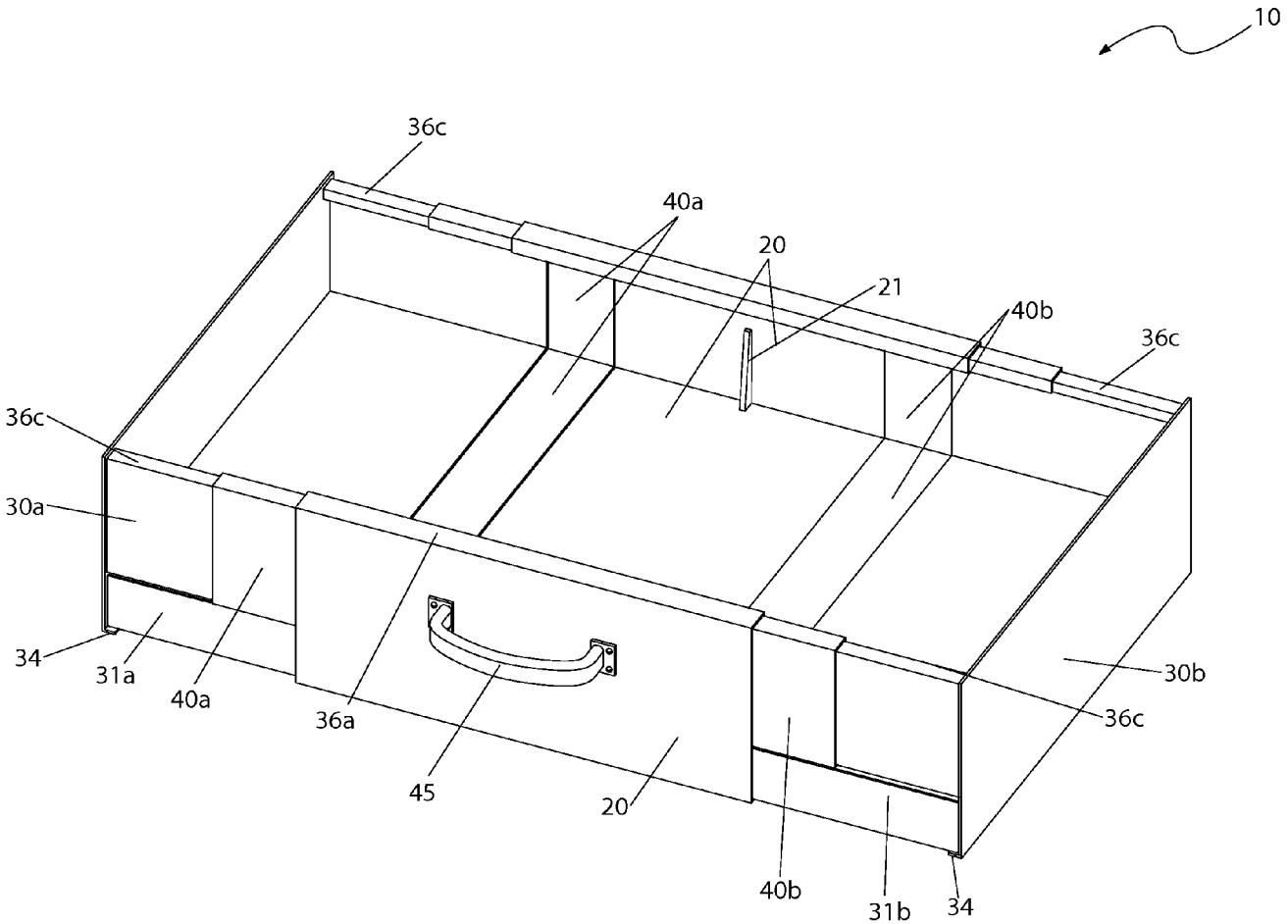
FIG. 1 is a perspective view of an expandable drawer, according to a preferred embodiment of the present invention.
Figure 2:
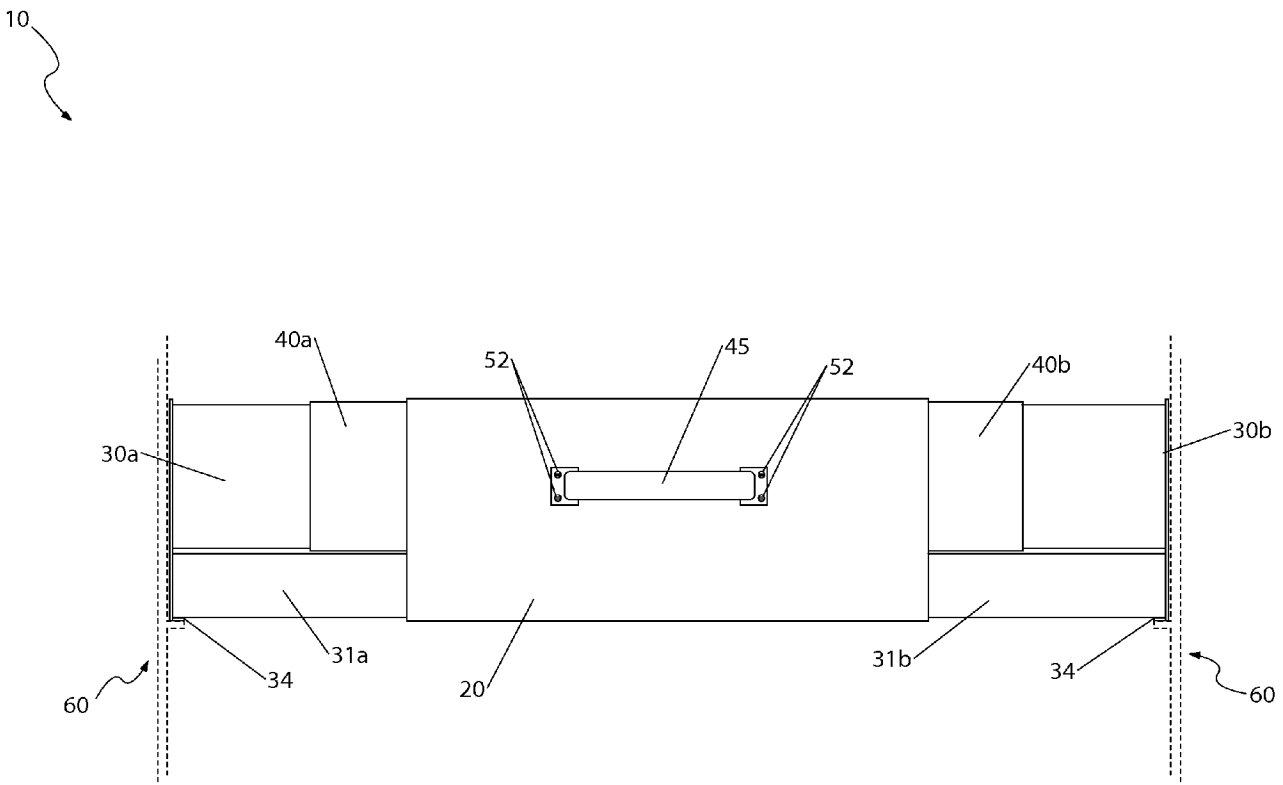
FIG. 2 is an environmental view of the expandable drawer depicted as removably mounted upon of a cabinet rail assembly 60, according to the preferred embodiment of the present invention.

Referring now to FIGS. 1 and 2, perspective and environmental views of the device 10, according to a preferred embodiment of the present invention, are disclosed. The device 10 comprises a center section 20, a first end section 30*a*, a second end section 30*b*, a first intermediate section 40*a*, and a second intermediate section 40*b*. The center section 20 comprises a first center side and a second center side opposite said first center side. The first end section 30*a* comprises a first end side and a second end side opposite said first end side. The second end section 30*b* comprises a third end side and a fourth end side opposite said third end side. The first intermediate section 40*a* comprises a first intermediate side and a second intermediate side opposite said first intermediate side. The second intermediate section 40*b* comprises a third intermediate side and a fourth intermediate side opposite said third intermediate side. The device 10 provides a universally installable drawer having adjustable features which allow a user to expand or retract a width dimension of the device 10 so as to fit in various sized drawer openings within an existing cabinet rail assembly portion 60 of drawer-type furniture. The device 10 is used in lieu of individually made drawer units that fit into a specific width cabinet rail assembly 60 by providing various selectable sizes via utilization of the expanding features of the device 10. The device 10 is removably inserted into and supported by an existing cabinet rail assembly 60 which provides edge support along both left and right sides of the device 10 in a conventional manner. The device 10 may be utilized within various models of cabinet rail assemblies 60 which support between one (1) and several units of the device 10. Each device 10 comprises a sliding assembly in which the aforementioned sections 20, 30*a*, 30*b*, 40*a*, 40*b* slide into each other along respective pairs of "U"-shaped center edge guides 36*a*, intermediate edge guides 36*b*, and end edge guides 36*c*.

In a preferred embodiment, the device 10 is to be adjustable in width from twelve (12) to thirty-six (36) inches. The device 10 may be easily installed in any size opening without specialized mill work, various woodworking, and other construction usually associated with custom cabinets and drawers.

The sections 20, 30*a*, 30*b*, 40*a*, 40*b* of the device 10 are preferably fabricated using formed and machined sheet metal panels; however, it is understood that other suitable materials such as wood, molded plastic portions, or the like, which are also designed to utilize the herein disclosed metallic adjusting and locking components, may be introduced without deviating from the teachings of the device 10, and as such should not be interpreted as a limiting factor of the invention 10. It is further understood that the device 10 may be introduced being coated with various colors, patterns, veneers, face boards, or the like which match existing furniture and/or decors.

Referring now to FIGS. 3 through 6*b*, exploded views of the device 10, according to the preferred embodiment of the present invention, are disclosed. The device 10 provides a means of width adjustment via a pair of inner rail guides 24*a*, a pair of outer rail guides 24*b*, a pair of inner extension rails 32*a*, a pair of outer extension rails 32*b*, and a plurality of tightening knob fasteners 50. Additionally, the vertical wall portions of said center 20, end 30*a*, 30*b*, and intermediate 40*a*, 40*b* sections are to extend along a common height to form a clean continuous upper edge profile once assembled.

The center section 20 and the adjacent first 40*a* and second 40*b* intermediate sections comprise unitary "U"-shaped members having slidingly inserting portions further comprising integral interlocking channel-shaped edge guide portions 36, 36*b*, 36*c* along respective top edge portions. Said center 20 and intermediate 40*a*, 40*b* sections include respective horizontal floor portions and front and rear opposing wall portions which extend upwardly from and perpendicularly from said floor portions. A front wall portion of the center section 20 further comprises a "U"-shaped or equivalently functioning pull handle 45 affixed to said center section 20 using common threaded fasteners 52, thereby enabling a user to easily extend and insert the device 10 within the cabinet rail assembly portion 60 of an existing furniture item such as a dresser. It is further envisioned that said center section 20 may comprise any number of integral triangular stiffeners 21 which extend between vertical wall portions and floor portions of said center section 20 to provide additional load-carrying capability.

The first 30*a* and second 30*b* end sections comprise a pair of mirror-image four (4) sided enclosures further comprising a floor portion and three (3) perpendicular side wall portions. Said end sections 30*a*, 30*b* are sized so as to insertingly interconnect with adjacent intermediate sections 40*a*, 40*b* also interlocking and being guided along a top edge via respective end edge guide 36*c* and intermediate edge guide 36*b* portions.

The center section 20 comprises a unitary construction further comprising a rectangularly-shaped subjacent tunnel portion 22 which provides enclosure of the aforementioned integral inner rail guide 24*a* and outer rail guide 24*b* portions. Said rail guides 24*a*, 24*b* comprise entrapping channel-shaped linear metal forms comprising triangular inner spaces sized so as to slidingly receive correspondingly shaped inner extension rail portions 32*a* of the first end section 30*a*, and outer extension rail portions 32*b* of the second end section 30*b* within. Said inner 32*a* and outer 32*b* extension rails are in turn permanently affixed to bottom surfaces of respective floor portions of said first 30*a* and second 30*b* end sections via welding or equivalent joining methods, and extend beyond an inward edge of bottom surfaces of said end sections 30*a*, 30*b*, being correspondingly positioned with respect to said inner 24*a* and outer 24*b* rail guides. Sliding insertion of said inner 24*a* and outer 24*b* rail guides into the respective inner 32*a* and outer 32*b* extension rails provides linear guided left and right motioning of said end sections 30*a*, 30*b* with respect to the center section 20.

Each of the extension rails 32*a*, 32*b* comprises a threaded aperture 33 at a distal end portion for receiving a standard threaded knob fastener 50. The knob fasteners 50 are threadingly inserted through respective threaded apertures 33 resulting in subsequent impingement upon an integral bearing plate portion 25 within each rail guide 24*a*, 24*b* during assembly and adjustment of the device 10. Said bearing plates 25 comprise a length of metal flat stock being located along respective outwardly facing vertical surfaces of said rail guides 24*a*, 24*b*. Said knob fasteners 50 are tightened against said bearing plate portions 25 of the rail guides 24*a*, 24*b* to provide a securing friction force to retain the extension rails 32*a*, 32*b* at a secure position with respect to the rail guide portions 24*a*, 24*b* of the center section 20. The tunnel portion 22 of the center section 20 also includes a plurality of elongated slots 26 which provide access to said knob fasteners 50 (see FIG. 7).

The tunnel portion 22 of the center section 20 further comprises a pair of skirt guides 42 located at opposing positions along the bottom surface. Said skirt guides 42 comprise "Ш"-shaped linear track members which provide guidance to a pair of first skirt portions 31*a* of the first end section 30*a*, and to a pair of second skirt portions 31*b* of the second end section 30*b*. Said skirt portions 31*a*, 31*b* each comprise integral flat vertical extension of front and rear side wall portions of respective end sections 30*a*, 30*b* being parallel and subjacent to the intermediate sections 40*a*, 40*b*, thereby providing discrete enclosure of the rail guide 24*a*, 24*b* and extension rail 32*a*, 32*b* portions.

It is envisioned that other styles and configurations of the present invention can be easily incorporated into the teachings of the present invention, and only one particular configuration shall be shown and described for purposes of clarity and disclosure and not by way of limitation of scope.

Figure 3:
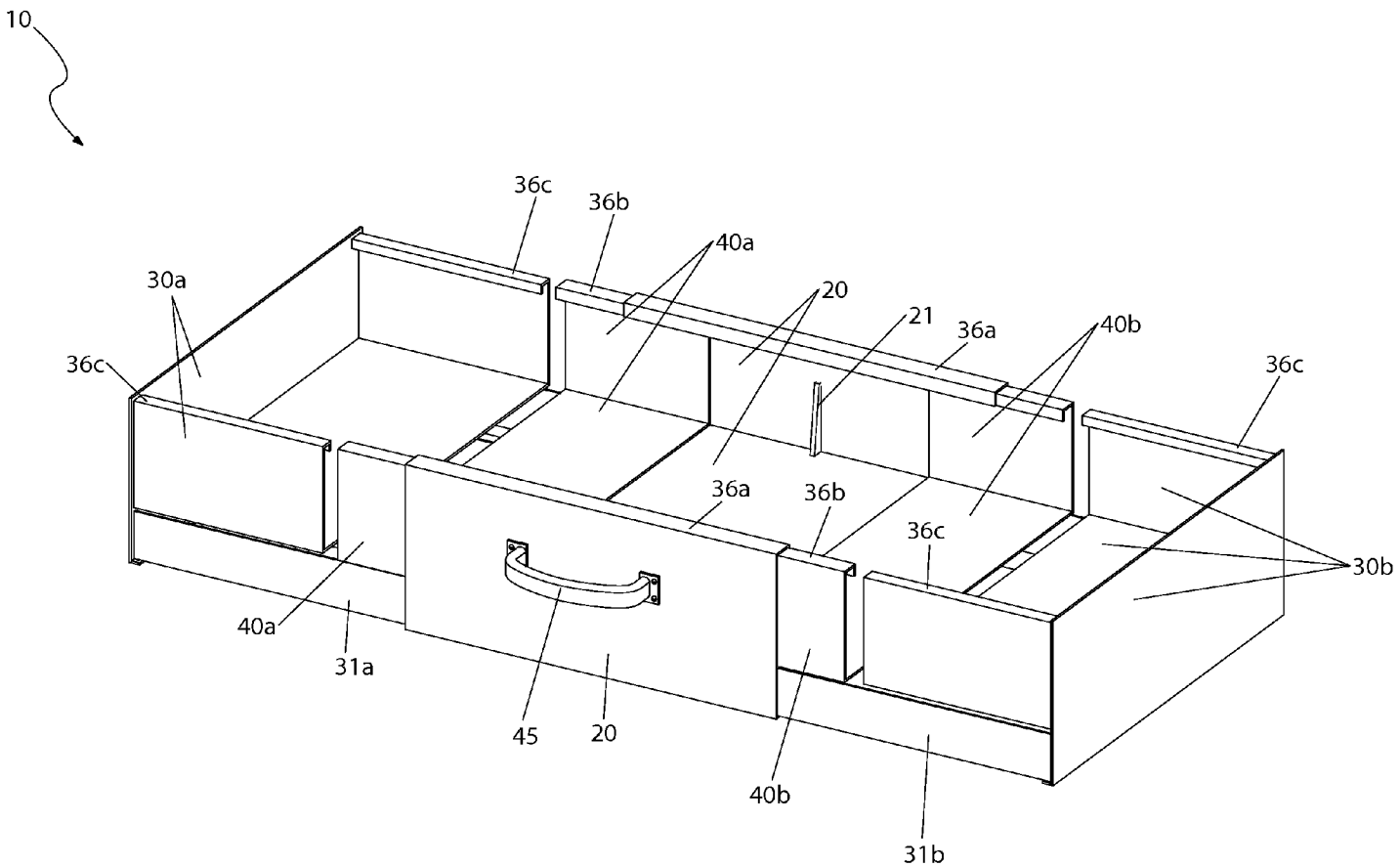
FIG. 3 is a partially exploded front view of the expandable drawer, according to the preferred embodiment of the present invention.
Figure 4:
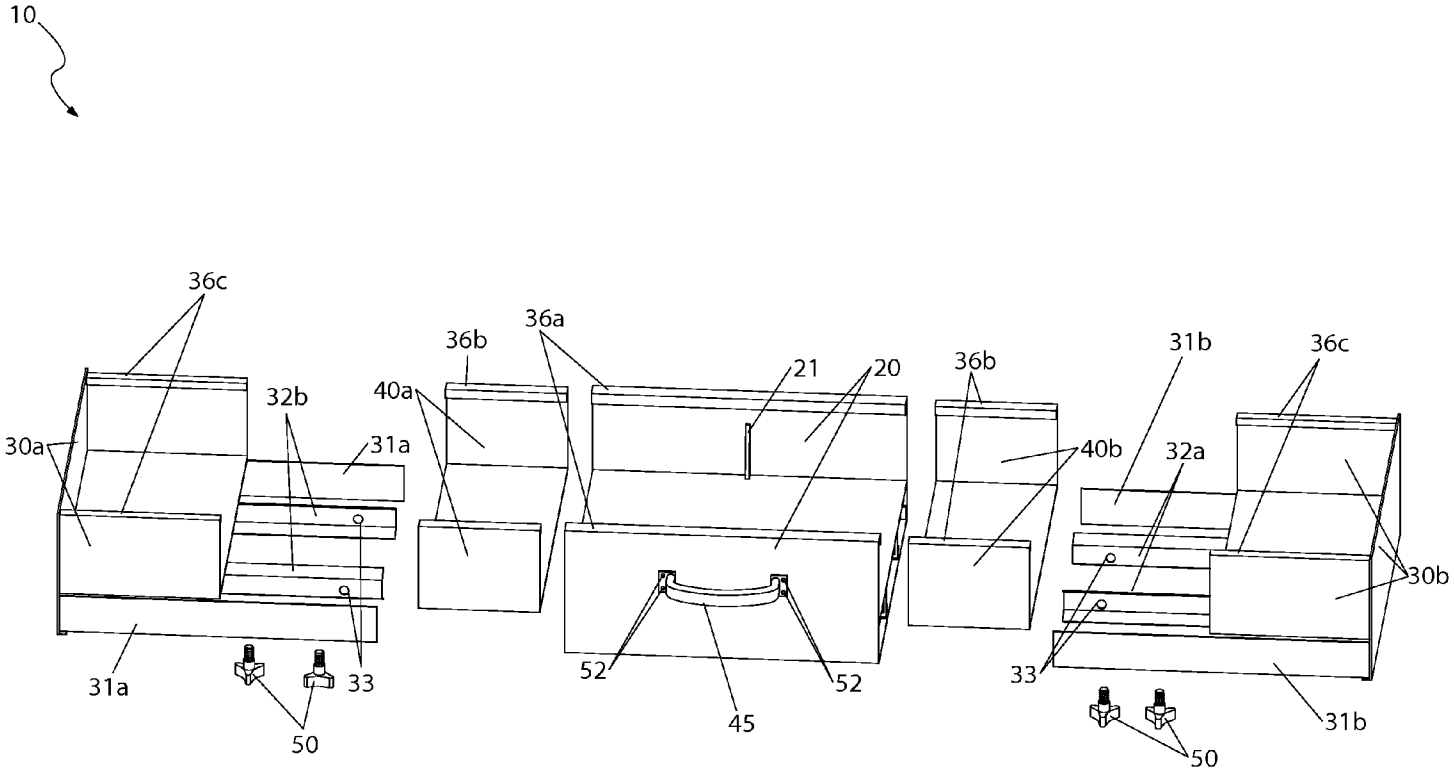
FIG. 4 is an exploded view of the expandable drawer, according to the preferred embodiment of the present invention.
Figure 5:
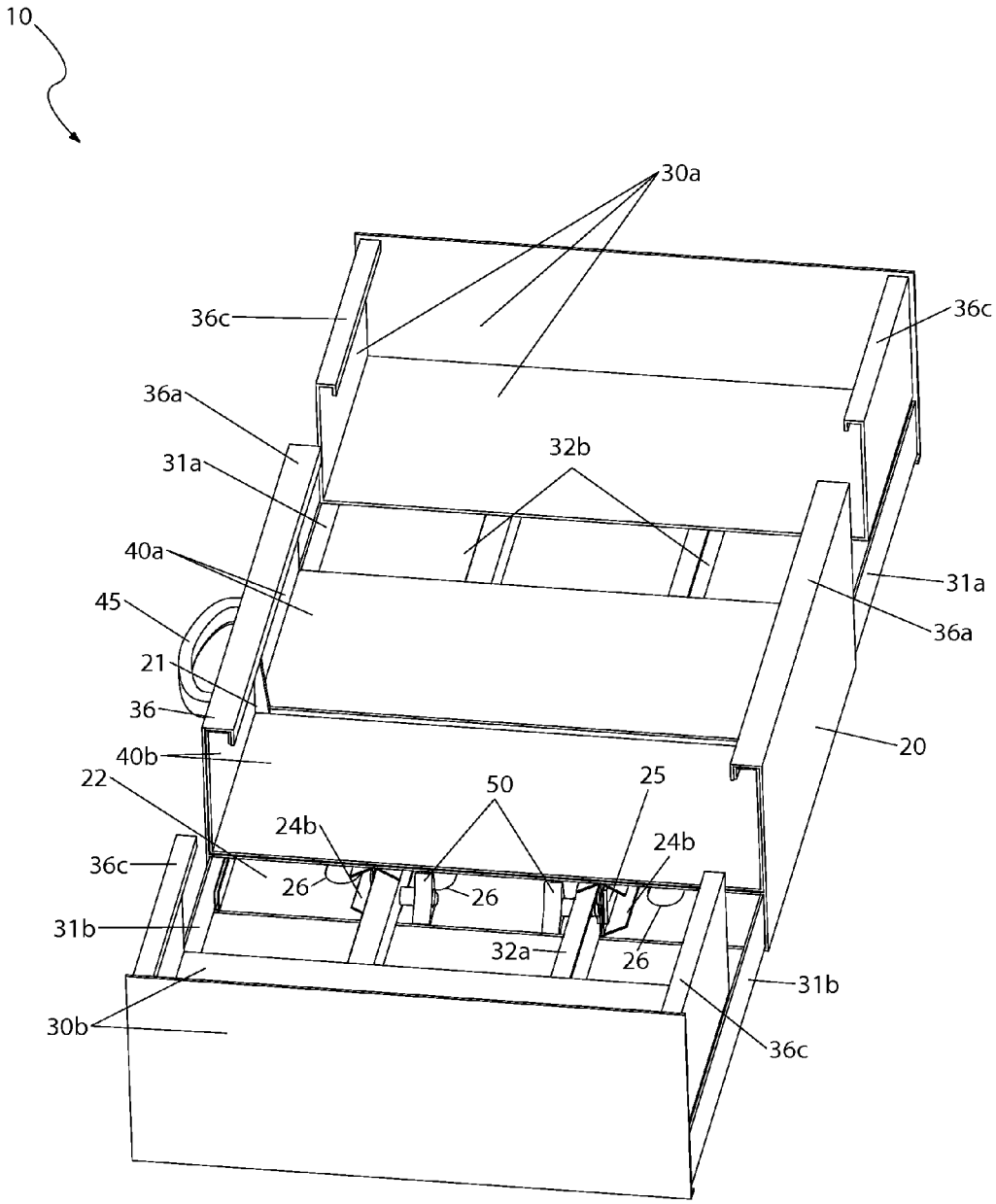
FIG. 5 is a partially exploded side view of the expandable drawer, according to the preferred embodiment of the present invention.
Figure 6A:
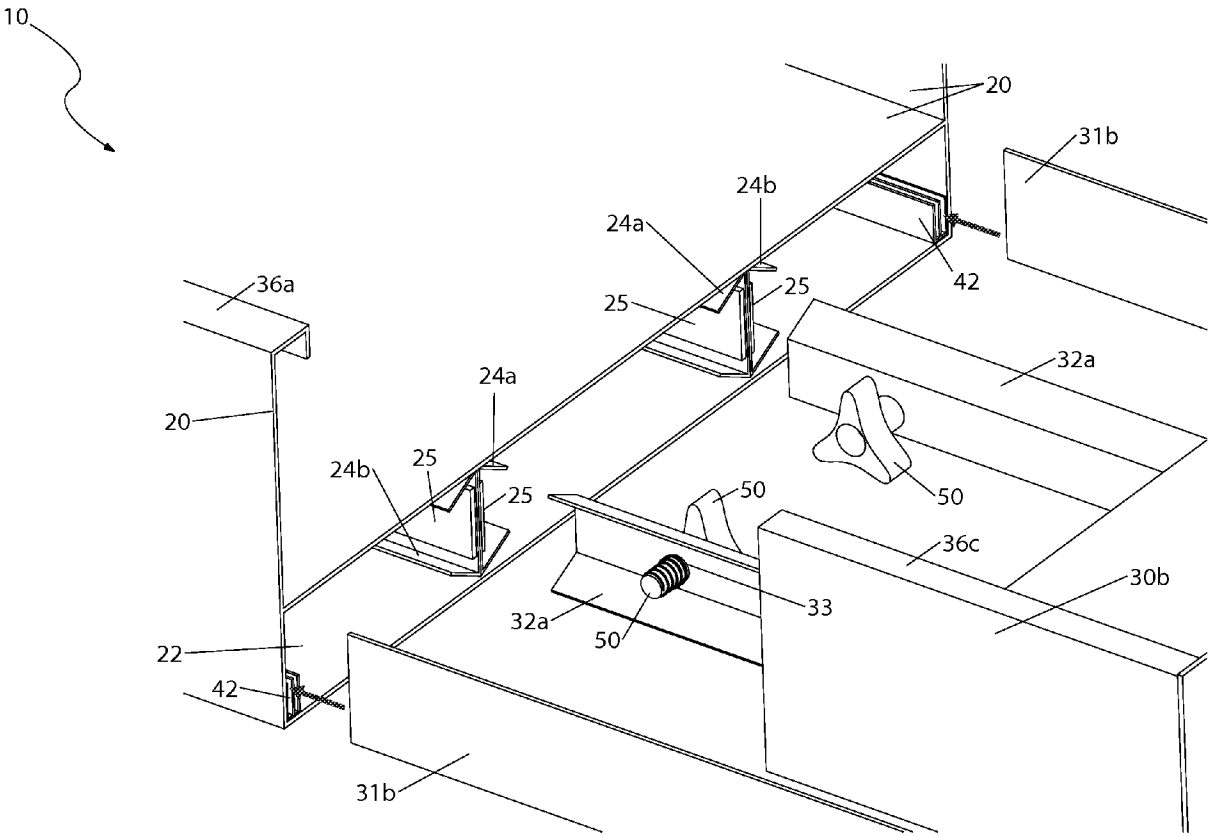

The aforementioned intermediate sections 40*a*, 40*b* are to sit atop the extension rails 32*a*, 32*b* and may be optionally installed if necessary to add additional width to the device 10. The intermediate edge guide portions 36*b* of the intermediate sections 40*a*, 40*b* are entrapped below the center 36*a* and end 36*c* edge guide portions of respective center 20 and end 30*a*, 30*b* sections, thereby providing a means to cover any gap within floor portions of said center 20 and end 30*a*, 30*b* sections which may result due to outward extension of said end sections 30*a*, 30*b* from said center section 20 as illustrated in FIG. 3.

Referring now to FIG. 7, a bottom view of the device 10, according to the preferred embodiment of the present invention, is disclosed. A bottom surface of the tunnel portion 22 of the center section 20 further comprises a plurality of parallel elongated slots 26 which provide access to said knob fasteners 50. Said slots 26 correspond to the various possible positions of said knob fasteners 50 based upon a desired selected width of the device 10, thereby providing a means to manually tighten or loosen said knob fasteners 50.

The end sections 30*a*, 30*b* further comprise a flat or "L"-shaped runner portion 34 affixed to left and right bottom outer edge regions preferably using fasteners 52 or equivalent attachment means, thereby providing smooth motioning of the device 10 upon the cabinet rail assembly 60 (see FIGS. 2 and 7). The runner 34 is envisioned to utilize common sliding or rolling components such as, but not limited to: rollers, castors, low-friction coatings, or the like, which contact the cabinet rail assembly 60, resulting in smooth forward and rearward motioning of the device 10 when being pulled out from or returned within said cabinet rail assembly 60.

The preferred embodiment of the present invention can be utilized by the common user in a simple and effortless manner with little or no training. After initial purchase or acquisition of the device 10, it would be installed and utilized as indicated in FIGS. 1, 2, and 3.

The method of utilizing the device 10 may be achieved by performing the following steps: procuring a model of the device 10 having a desired material and color; measuring a width of an existing cabinet rail assembly 60 into which the device 10 is to be installed; pre-adjusting a width of the device 10 by loosening the knob fasteners 50; extending each end section 30*a*, 30*b* an equal distance from the center section 20 until obtaining the desired width of the device 10; installing the intermediate sections 40*a*, 40*b* in such an event as a gap appearing between the center 20 and end 30*a*, 30*b* sections by positioning the intermediate edge guide portions 36*b* of each intermediate section 40*a*, 40*b* over the end edge guide portions 36*c* of the adjacent end sections 30*a*, 30*b* and positioning said intermediate edge guide portions 36*b* of each intermediate section 40*a*, 40*b* under the center edge guide portions 36*a* of the center section 20; tightening the knob fasteners 50; sliding the device 10 partially into the existing cabinet rail assembly 60; loading the device 10 with various items to be stowed in a normal manner; sliding the device 10 fully into the existing cabinet rail assembly 60 using the handle 45; repeating the above steps to install additional units of the device 10 upon the cabinet rail assembly 60 as needed; and, benefiting from increased storage space within a variety of areas without the high cost or specialized work associated with custom-made cabinets.

The materials required to produce the device 10 are all readily available and well known to manufacturers of goods of this type. The majority of the components as used in the device 10 are preferably made of sheet steel in a stamping process. This process would require the design and use of custom dies. Should large-scale manufacture of the device 10 be undertaken, various jigs and other assembly aids would be needed to speed production and ensure consistency. The remaining components of the device 10, namely the specialized fasteners would best be procured from wholesalers and manufacturers that deal in goods of that nature and assembled at a final location. The relatively simple design of the device 10 and the material of construction make it a cost-effective design due to the relatively low material and labor costs involved. Final production of the device 10 will be performed by manufacturing workers of average skill.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An expandable drawer, comprising:

a center section, comprising a first center side and a second center side opposite said first side and further comprising a unitary "U"-shaped member having a center floor, a center rear wall, a center front wall, a tunnel portion extending downward from said center floor and coextensive with an area thereof, a plurality of elongated slots located along said tunnel portion, a pair of skirt guides located at opposing bottom surfaces of said tunnel portion subjacent to said center front wall and said center rear wall, a center edge guide portion along a top edge of said center front wall and said center rear wall;

a first intermediate section having a first intermediate side and a second intermediate side opposite said first intermediate side and further comprising a unitary "U"-shaped member having a first intermediate floor, a first intermediate rear wall, a first intermediate front wall, and a first intermediate edge guide portion along a top edge of said first intermediate front wall and said first intermediate rear wall, said first intermediate edge guide portion slidably received within said center edge guide portion of said first center side;

a second intermediate section having a third intermediate side and a fourth intermediate side opposite said third intermediate side and further comprising a unitary "U"-shaped member having a second intermediate floor, a second intermediate rear wall, a second intermediate front wall, and a second intermediate edge guide portion along a top edge of said second intermediate front wall and said second intermediate rear wall, said second intermediate edge guide portion slidably received within said center edge guide portion of said second center side;

a first end section having a first end side slidingly engaging with said second intermediate side and a second end side opposite said first end side;

a second end section having a third end side slidingly engaging with said fourth intermediate side and a fourth end side opposite said third end side; and, a width adjustment means for adjusting a relative width of said first end relative to said center section and for adjusting a relative width of said second end relative to said center section;

wherein said plurality of slots enables access to said width adjustment means;

wherein said width adjustment means enables said drawer to be expandable to fit in various sized drawer openings between a fully retracted state and a fully expanded state;

wherein said first intermediate side and said second intermediate side slides over said center floor; and, wherein said width adjustment means enables said first end section and said second end section to be independently adjustable relative to said center section.

2. The drawer of claim 1, further comprising a pull handle affixed to said center front wall.

3. The drawer of claim 1, further comprising at least one stiffener affixed between said center floor and said center rear wall.

4. The drawer of claim 1, further comprising:

wherein said first end section comprises a four-sided enclosure having a first end floor, a first end rear wall, a first end side wall, a first end front wall, a pair of first skirt portions each extending outward from opposing edges of said first end front wall and first end rear wall at said first end side, and a first end edge guide portion;

wherein said second end section comprises a four-sided enclosure having a second end floor, a second end rear wall, a second end side wall, a second end front wall, a pair of second skirt portions each extending outward from opposing edges of said second end front wall and second end rear wall at said third end side, and a second end edge guide portion;

wherein said pair of first skirt portions are slidingly received within said pair of skirt guides located at said first center side of said center section;

wherein said pair of second skirt portions are slidingly received within said pair of skirt guides located at said second center side of said center section;

wherein said pair of first skirt portions and said pair of second skirt portions provides a discrete enclosure of said adjustment means;

wherein said first intermediate edge guide portion of said second intermediate side slidably receives said first end edge guide portion of said first end side;

wherein said second intermediate edge guide portion of said fourth intermediate side slidably receives said second end edge guide portion of said third end side; and, wherein said third intermediate side slides under said first end floor and said fourth intermediate side slides under said second end floor.

5. The drawer of claim 1, wherein said width adjustment means further comprises:

a pair of inner rail guides affixed to a bottom surface of said center floor within said tunnel portion;

a bearing plate portion integral within each of said pair of inner rail guides and located along outwardly facing vertical surfaces thereof;

a pair of first inner extension rails affixed to an outer surface of said first end floor and having a distal end extend outwardly from said first end side, further having an aperture at said distal end; and, a pair of second inner extension rails affixed to an outer surface of said second end floor and having a distal end extend outwardly from said third end side, further having an aperture at said distal end;

wherein each of said pair of first inner extension rails are slidingly received within each of said pair of inner rail guides at said center section first side;

wherein each of said pair of second inner extension rails are slidingly received within each of said pair of inner rail guides at said center section second side;

wherein a fastener is inserted within said aperture of each of said pair of first inner extension rails and impinges upon said bearing plate portion to secure said first end section to said center section at a desired width; and, wherein a fastener is inserted within said aperture of each of said pair of second inner extension rails and impinges upon said bearing plate portion to secure said second end section to said center section at a desired width.

6. The drawer of claim 5, further comprising:

wherein said pair of inner extension guides each further comprises an elongated center guide section having a pair of guide arms extending inwardly at an angle therefrom, said pair of arms longitudinally coextensive with said center guide section;

wherein said pair of first inner extension rails each further comprises an elongated first center rail section having a pair of first rail arms extending outwardly at an angle therefrom, said pair of first rail arms longitudinally coextensive with said first center rail section;

wherein said pair of second inner extension rails each further comprises an elongated second center rail section having a pair of second rail arms extending outwardly at an angle therefrom, said pair of second rail arms longitudinally coextensive with said second center rail section; and, wherein said bearing plate portion is longitudinally coextensive with said center guide section.

7. The drawer of claim 1, wherein said fully retracted state is approximately twelve inches and said fully expanded state is approximately thirty-six inches.

8. An expandable drawer, comprising:

a center section, comprising a first center side and a second center side opposite said first side and further comprising a unitary "U"-shaped member having a center floor, a center rear wall, a center front wall, a tunnel portion extending downward from said center floor and coextensive with an area thereof, a plurality of elongated slots located along said tunnel portion, a pair of skirt guides located at opposing bottom surfaces of said tunnel portion subjacent to said center front wall and said center rear wall, a center edge guide portion along a top edge of said center front wall and said center rear wall;

a first intermediate section having a first intermediate side and a second intermediate side opposite said first intermediate side and further comprising a unitary "U"-shaped member having a first intermediate floor, a first intermediate rear wall, a first intermediate front wall, and a first intermediate edge guide portion along a top edge of said first intermediate front wall and said first intermediate rear wall, said first intermediate edge guide portion slidably received within said center edge guide portion of said first center side;

a second intermediate section having a third intermediate side and a fourth intermediate side opposite said third intermediate side and further comprising a unitary "U"-shaped member having a second intermediate floor, a second intermediate rear wall, a second intermediate front wall, and a second intermediate edge guide portion along a top edge of said second intermediate front wall and said second intermediate rear wall, said second intermediate edge guide portion slidably received within said center edge guide portion of said second center side;

a first end section having a first end side slidingly engaging with said second intermediate side and a second end side opposite said first end side;

a second end section having a third end side slidingly engaging with said fourth intermediate side and a fourth end side opposite said third end side;

a width adjustment means for adjusting a relative width of said first end relative to said center section and for adjusting a relative width of said second end relative to said center section; and, a first runner portion affixed to a bottom surface of said first end section at said second end side; and, a second runner portion affixed to a bottom surface of said second end section at said fourth end side;

wherein said plurality of slots enables access to said width adjustment means;

wherein said width adjustment means enables said drawer to be expandable to fit in various sized drawer openings between a fully retracted state and a fully expanded state;

wherein said first intermediate side and said second intermediate side slides over said center floor;

wherein said width adjustment means enables said first end section and said second end section to be independently adjustable relative to said center section; and, wherein said first runner portion and said second runner portion is adapted to be received within a cabinet rail assembly.

9. The drawer of claim 8, further comprising a pull handle affixed to said center front wall.

10. The drawer of claim 8, further comprising at least one stiffener affixed between said center floor and said center rear wall.

11. The drawer of claim 8, further comprising:

wherein said first end section comprises a four-sided enclosure having a first end floor, a first end rear wall, a first end side wall, a first end front wall, a pair of first skirt portions each extending outward from opposing edges of said first end front wall and first end rear wall at said first end side, and a first end edge guide portion;

wherein said second end section comprises a four-sided enclosure having a second end floor, a second end rear wall, a second end side wall, a second end front wall, a pair of second skirt portions each extending outward from opposing edges of said second end front wall and second end rear wall at said third end side, and a second end edge guide portion;

wherein said pair of first skirt portions are slidingly received within said pair of skirt guides located at said first center side of said center section;

wherein said pair of second skirt portions are slidingly received within said pair of skirt guides located at said second center side of said center section;

wherein said pair of first skirt portions and said pair of second skirt portions provides a discrete enclosure of said adjustment means;

wherein said first intermediate edge guide portion of said second intermediate side slidably receives said first end edge guide portion of said first end side;

wherein said second intermediate edge guide portion of said fourth intermediate side slidably receives said second end edge guide portion of said third end side; and, wherein said third intermediate side slides under said first end floor and said fourth intermediate side slides under said second end floor.

12. The drawer of claim 8, wherein said width adjustment means further comprises:

a pair of inner rail guides affixed to a bottom surface of said center floor within said tunnel portion;

a bearing plate portion integral within each of said pair of inner rail guides and located along outwardly facing vertical surfaces thereof;

a pair of first inner extension rails affixed to an outer surface of said first end floor and having a distal end extend outwardly from said first end side, further having an aperture at said distal end; and, a pair of second inner extension rails affixed to an outer surface of said second end floor and having a distal end extend outwardly from said third end side, further having an aperture at said distal end;

wherein each of said pair of first inner extension rails are slidingly received within each of said pair of inner rail guides at said center section first side;

wherein each of said pair of second inner extension rails are slidingly received within each of said pair of inner rail guides at said center section second side;

wherein a fastener is inserted within said aperture of each of said pair of first inner extension rails and impinges upon said bearing plate portion to secure said first end section to said center section at a desired width; and, wherein a fastener is inserted within said aperture of each of said pair of second inner extension rails and impinges upon said bearing plate portion to secure said second end section to said center section at a desired width.

13. The drawer of claim 12, further comprising:

wherein said pair of inner extension guides each further comprises an elongated center guide section having a pair of guide arms extending inwardly at an angle therefrom, said pair of arms longitudinally coextensive with said center guide section;

wherein said pair of first inner extension rails each further comprises an elongated first center rail section having a pair of first rail arms extending outwardly at an angle therefrom, said pair of first rail arms longitudinally coextensive with said first center rail section;

wherein said pair of second inner extension rails each further comprises an elongated second center rail section having a pair of second rail arms extending outwardly at an angle therefrom, said pair of second rail arms longitudinally coextensive with said second center rail section; and, wherein said bearing plate portion is longitudinally coextensive with said center guide section.

14. The drawer of claim 8, wherein said fully retracted state is approximately twelve inches and said fully expanded state is approximately thirty-six inches.

* * * * *